US009593886B2

(12) United States Patent
Katou et al.

(10) Patent No.: US 9,593,886 B2
(45) Date of Patent: Mar. 14, 2017

(54) HEAT EXCHANGER AND HEAT PUMP DEVICE USING THE SAME

(75) Inventors: Isao Katou, Gunma (JP); Naotaka Iwasawa, Gunma (JP); Hirotaka Kado, Gunma (JP)

(73) Assignee: SANDEN HOLDINGS CORPORATION, Gunma (JP)

( * ) Notice: Subject to any disclaimer, the term of this patent is extended or adjusted under 35 U.S.C. 154(b) by 1003 days.

(21) Appl. No.: 13/057,408

(22) PCT Filed: Aug. 5, 2009

(86) PCT No.: PCT/JP2009/064216
§ 371 (c)(1),
(2), (4) Date: Feb. 3, 2011

(87) PCT Pub. No.: WO2010/016615
PCT Pub. Date: Feb. 11, 2010

(65) Prior Publication Data

US 2011/0132020 A1 Jun. 9, 2011

(30) Foreign Application Priority Data

Aug. 7, 2008 (JP) ..... 2008-204278

(51) Int. Cl.

| | |
|---|---|
| ***F25B 30/00*** | (2006.01) |
| ***F28F 1/12*** | (2006.01) |
| ***F28D 1/047*** | (2006.01) |
| ***F25B 39/00*** | (2006.01) |
| ***F28F 1/32*** | (2006.01) |

(52) U.S. Cl.
CPC ..... *F28D 1/0477* (2013.01); *F25B 39/00* (2013.01); *F28F 1/32* (2013.01); *F25B 2500/01* (2013.01)

(58) Field of Classification Search
USPC ..... 62/507, 515; 165/179, 182, 150, 151
See application file for complete search history.

(56) References Cited

U.S. PATENT DOCUMENTS

2007/0163764 A1* 7/2007 Kaga et al. ..... 165/151

FOREIGN PATENT DOCUMENTS

| | | | | |
|---|---|---|---|---|
| GB | 2011604 A | * | 7/1979 | ..... F28F 1/10 |
| JP | 62245089 A | * | 10/1987 | ..... F28F 1/32 |
| JP | 62245092 A | * | 10/1987 | ..... F28F 1/32 |

(Continued)

OTHER PUBLICATIONS

Beale, S. B. (1993) Fluid Flow and Heat Transfer in Tube Banks, Ph.D. Thesis, University of London.*

(Continued)

*Primary Examiner* — Ryan J Walters
*Assistant Examiner* — Christopher R Zerphey
(74) *Attorney, Agent, or Firm* — Hauptman Ham, LLP

(57) ABSTRACT

Provided are a heat exchanger capable of providing sufficient heat exchange capability even with heat transfer tubes having a reduced outer diameter, and a heat pump device using the same. The heat transfer tubes has an outer diameter D in a range of 5 mm≤D≤6 mm, has a thickness t in a range of 0.05×D≤t≤0.09×D, are disposed at a vertical pitch L1 in a range of 3×D≤L1≤4.2×D, and are disposed at a longitudinal pitch L2 in a range of 2.6×D≤L2≤3.64×D. A sufficiently increased heat exchange rate per unit weight is obtainable with the heat exchanger.

8 Claims, 8 Drawing Sheets

(56) References Cited

FOREIGN PATENT DOCUMENTS

| | | | | | | |
|---|---|---|---|---|---|---|
| JP | 63003188 | A | * | 1/1988 | ..... | F28F 1/32 |
| JP | 63041790 | A | * | 2/1988 | ..... | F28F 1/12 |
| JP | 63197884 | A | * | 8/1988 | ..... | F28F 1/32 |
| JP | 01159597 | A | * | 6/1989 | ..... | F28F 1/32 |
| JP | 2000274982 | | | 10/2000 | | |
| JP | 2001091183 | | | 4/2001 | | |
| JP | 2002243383 | A | | 8/2002 | | |
| JP | 2002257483 | | | 9/2002 | | |
| JP | 2003139479 | | | 5/2003 | | |
| JP | 2005009827 | | | 1/2005 | | |
| JP | 2006194476 | | | 7/2006 | | |
| JP | 18194476 | | * | 7/2007 | ..... | F28F 1/00 |

OTHER PUBLICATIONS

International Search Report for PCT/JP2009/064216 mailed Oct. 27, 2009.

Supplemental European Search Report for Application No. 09805094.1 mailed Feb. 15, 2013.

Office Action mailed Nov. 11, 2013 corresponds to European patent application No. 09805094.1.

* cited by examiner

HEAT EXCHANGER AND HEAT PUMP DEVICE USING THE SAME

RELATED APPLICATIONS

The present application is a national phase of PCT/JP2009/064216 filed Aug. 5, 2009 and is based on, and claims priority from, Japanese Application Number 2008-204278, filed Aug. 7, 2008.

TECHNICAL FIELD

The present invention relates to heat exchangers for performing heat exchange between a refrigerant and a gas (e.g. the air) in air conditioning, freezing, refrigerating, water heating, and the like. The invention more particularly relates to heat exchangers for use as, for example, an evaporator in a refrigerant circuit using a carbon dioxide refrigerant and to heat pump devices using the heat exchangers.

BACKGROUND ART

Conventionally known heat pump water heaters of this type include one configured to store, in a water storage tank, water to be supplied, which water is heated by a water heat exchanger, and to supply the hot water in the water storage tank to a bathtub and a kitchen (e.g. see Patent Document 1). The refrigerant circuit of the heat pump water heater includes a compressor, an evaporator, an expansion valve, and a water heat exchanger (a gas cooler). Carbon dioxide is used as the refrigerant. The evaporator includes a plurality of heat transfer tubes and a plurality of heat transfer fins. The heat transfer tubes are spaced from one another in the radial direction thereof and are arranged vertically and longitudinally. The plurality of heat transfer fins are spaced from one another and disposed in the axial direction of the heat transfer tubes. Heat exchange is effected between the refrigerant that circulates through the heat transfer tubes and the outside air by means of the heat transfer fins.

Recently, further improvement is desired with this type of heat exchanger for an increased heat exchange rate and reduced dimensions and weight, in company with the demand for higher performance and reduced dimensions of the instruments to which the heat exchanger is applied. Thus, fin-tube heat exchangers improved in these respects are proposed (e.g. see Patent Document 2). The heat exchanger of Patent Document 2 includes a plurality of heat transfer tubes and a plurality of heat transfer fins. The heat transfer tubes are spaced from one another in the radial direction thereof and are arranged vertically and longitudinally. The heat transfer fins are spaced from one another and disposed in the axial direction of the heat transfer tubes. It is taught that an increased heat exchange rate and reduced dimensions and weight of the heat exchanger are achieved when the tube outer diameter D of the heat transfer tubes is in a range of $1\ \text{mm} \leq D < 5\ \text{mm}$, the longitudinal tube row pitch L1 of the heat transfer tubes is in a range of $2.5\ D < L1 \leq 3.4\ D$, and the vertical tube stage pitch L2 of the heat transfer tubes is in a range of $3.0\ D < L2 \leq 3.9\ D$.

Patent Document 1: JP-A-2006-046877

Patent Document 2: JP-A-2005-009827

DISCLOSURE OF THE INVENTION

Problems to be Solved by the Invention

The heat transfer tubes for use in heat exchangers for evaporators are generally copper tubes of 6 mm to 7 mm in outer diameter. In case where a carbon dioxide refrigerant is used for circulation through copper tubes of this outer diameter, it is said that the heat transfer tubes need to have a thickness of at least 0.4 mm to 0.5 mm to ensure durability against the high pressure of the refrigerant. However, in order to obtain sufficient heat exchange capability, the number of heat transfer tubes need to be increased, which leads to an increase in weight of the heat transfer tubes, hence an increase in cost. In order to reduce the weight, the outer diameter of the heat transfer tubes needs to be reduced. However, reduction in outer diameter of the heat transfer tubes may hinder ensuring sufficient heat exchange capability. Excessive reduction in inner diameter of heat transfer tubes will cause a great increase in pressure loss of the refrigerant to run through the heat transfer tubes, thus disadvantageously leading to a significant fall in heat exchange capability. The outer diameter, inner diameter, thickness, respective arrangement pitches in the vertical and longitudinal directions of heat transfer tubes, fin pitch, and the like are principal dominant factors over the heat exchange capability and total weight of a heat exchanger. For this reason, appropriate values need to be set for these principal factors so as to increase the heat exchange capability per unit weight of the heat exchanger for ensuring sufficient heat exchange capability and achieving reduced dimensions and weight of the heat exchanger.

However, in the background art, such attempts have not been made as to set appropriate values for the principle factors from the viewpoint of increasing heat exchange capability per unit weight of heat exchangers. For example, according to the invention of Patent Document 2, the outer diameter of the heat transfer tubes is set not less than 1 mm and less than 5 mm; when the outer diameter is set in this range, a leap in pressure loss may disadvantageously occur in the refrigerant that runs through the heat transfer tubes, resulting in a significant fall in heat exchange capability. According to the result of numerical analysis conducted by the inventors on the pressure loss (see FIG. 13), the pressure loss of a refrigerant that runs through heat transfer tubes increases exponentially with reduction in inner diameter of the heat transfer tubes from 4 mm in case where the refrigerant is carbon dioxide, while the pressure loss increases exponentially with reduction in inner diameter of the heat transfer tubes from 7 mm in case where the refrigerant is the conventionally used fluorocarbon (R410A). The pressure loss of the carbon dioxide refrigerant in the heat transfer tubes of 4 mm in inner diameter is approximately equal in value to the pressure loss of the fluorocarbon refrigerant in the heat transfer tubes of 7 mm in inner diameter. Accordingly, in case where the outer diameter of the heat transfer tubes is set not less than 1 mm and less than 5 mm as in the invention of Patent Document 2, the pressure loss of the carbon dioxide refrigerant that runs through the heat transfer tubes disadvantageously will have extremely increased values in most of the range, resulting in a significant fall in heat exchange capability.

The present invention was made in view of the above problems, and it is an object of the invention to provide a heat exchanger that is capable of providing sufficient heat exchange capability with reduced dimensions and weight by increasing heat exchange capability per unit weight of the heat exchanger. A heat pump device using the heat exchanger is also provided.

Solutions to the Problems

In order to achieve the above object, a heat exchanger of an aspect of the invention includes: a plurality of heat transfer tubes spaced from one another in a radial direction thereof and arranged vertically and longitudinally; a plurality of heat transfer fins spaced from one another and disposed in an axial direction of the heat transfer tubes; and a carbon dioxide refrigerant provided for circulation through the heat transfer tubes. The heat transfer tubes has an outer diameter D in a range of 5 mm≤D≤6 mm, the heat transfer tubes has a thickness t in a range of 0.05×D≤t≤0.09×D, the heat transfer tubes are disposed at a vertical pitch L1 in a range of 3×D≤L1≤4.2×D, and the heat transfer tubes are disposed at a longitudinal pitch L2 in a range of 2.6×D≤L2≤3.64×D.

In the above aspect, the outer diameter D of the heat transfer tubes is preferably in a range of 5 mm≤D≤5.5 mm. In this manner, a maximum heat exchange rate per unit weight is achievable with the heat exchanger. Further, in the above aspect, the number of longitudinal rows N of the heat transfer tubes is preferably in a range of 2≤N≤8, and the heat transfer fins along a lateral direction of the heat exchanger are preferably disposed at a pitch Fp having such a value that Fp/N (hereinafter "fin pitch Fp/N") is in a range of 0.5 mm≤Fp/N≤0.9 mm, the Fp/N value being given by dividing Fp by the number of longitudinal rows N of the heat transfer tubes. In this manner, a maximum heat exchange rate per unit opening area and unit temperature difference is achievable with the heat exchanger.

Moreover, in order to achieve the foregoing object, a heat pump device of an aspect of the invention includes the heat exchanger of any of the above aspects as an evaporator of a refrigerant circuit thereof. In this manner, enhanced heat exchange capability per unit power, as well as a remarkably increased coefficient of performance (COP) in comparison with a conventional level, is obtainable with the heat pump device.

Effects of the Invention

According to the invention, the heat exchange capability per unit weight of heat exchangers can be enhanced to a maximum level or a level close to a maximum level. Thus, sufficient heat exchange capability, as well as reduced dimensions and weight, of the heat exchangers is achieved. Further, according to a preferred embodiment of the invention, the heat exchange rate per unit opening area and unit temperature difference of a heat exchanger can be raised to a maximum level; thus, the heat exchange capability can be further enhanced, and the dimensions and weight of the heat exchanger can be further reduced.

DESCRIPTION OF REFERENCE SIGNS

1 heat exchanger
2 heat transfer tube
3 heat transfer fin
13 evaporator

BEST MODE FOR CARRYING OUT THE INVENTION

An embodiment of the invention is specifically described below with reference to the drawings.

Example 1

Figure 1:
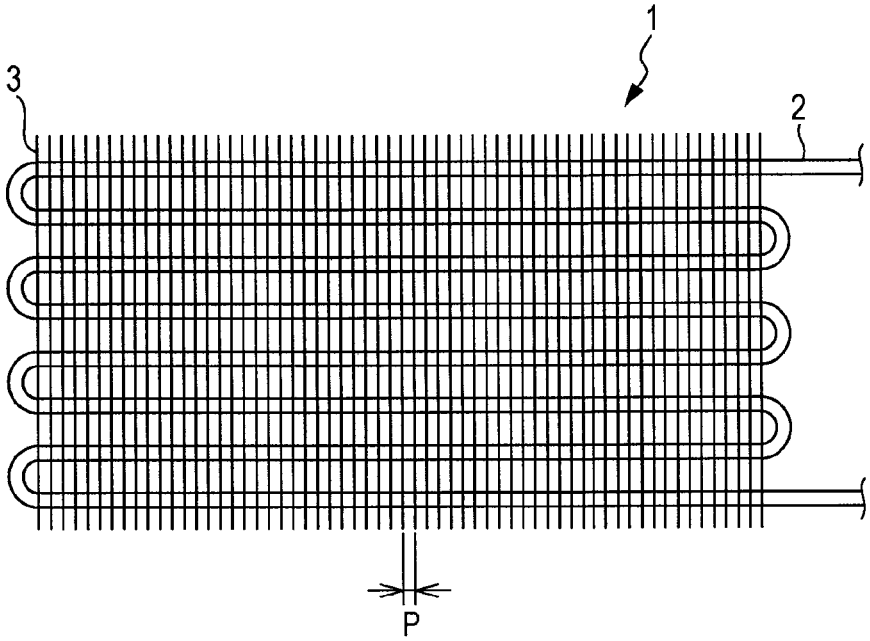
FIG. 1 illustrates a front view of a heat exchanger.
Figure 2:
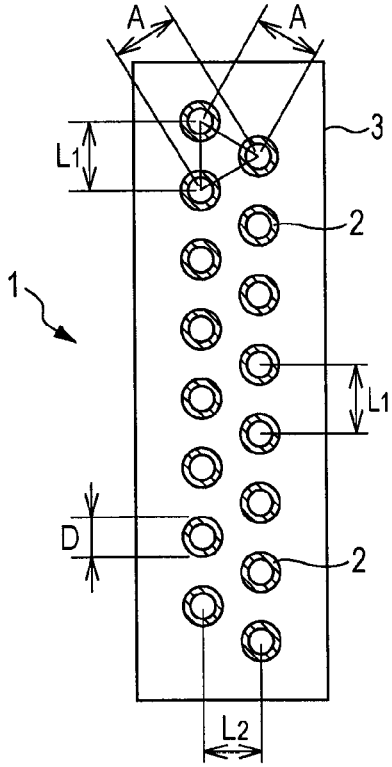
FIG. 2 illustrates a side view of the heat exchanger.

In FIGS. 1 and 2, a heat exchanger 1 includes a plurality of heat transfer tubes 2 and a plurality of heat transfer fins 3. The heat transfer tubes 2 are spaced from one another in a radial direction thereof and are arranged vertically and longitudinally. The heat transfer fins 3 are spaced from one another and disposed in an axial direction of the heat transfer tubes 2. A carbon dioxide refrigerant runs through the heat transfer tubes 2. The heat transfer tubes 2 may be copper tubes that extend in a lateral direction of the heat exchanger 1 and are formed in a meandering manner such that the tubes 2 are bent at the lateral ends of the heat exchanger 1. The heat transfer fins 3 may be plate-shaped aluminum and are disposed at a predetermined fin pitch Fp along the lateral direction of the heat exchanger 1. The heat transfer tubes 2 are disposed such that an equilateral triangle is formed by the center-to-center lines of heat transfer tubes 2 that adjoin each other in the vertical and longitudinal directions. Thus, the center-to-center distance A between two longitudinally adjoining heat transfer tubes 2 is equal to the vertical pitch L1 of the heat transfer tubes 2. Accordingly, the longitudinal pitch L2 of the heat transfer tubes 2 establishes a relationship of L2=L1×cosine 30°.

Figure 3:
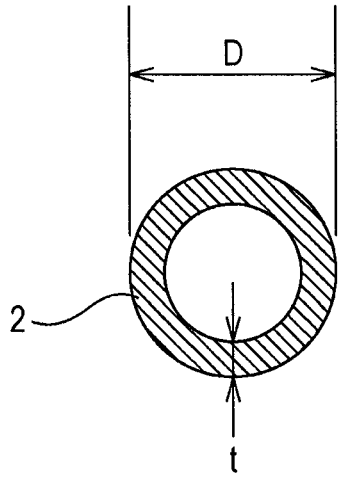
FIG. 3 illustrates a radial cross-sectional view of a heat transfer tube.
Figure 13:
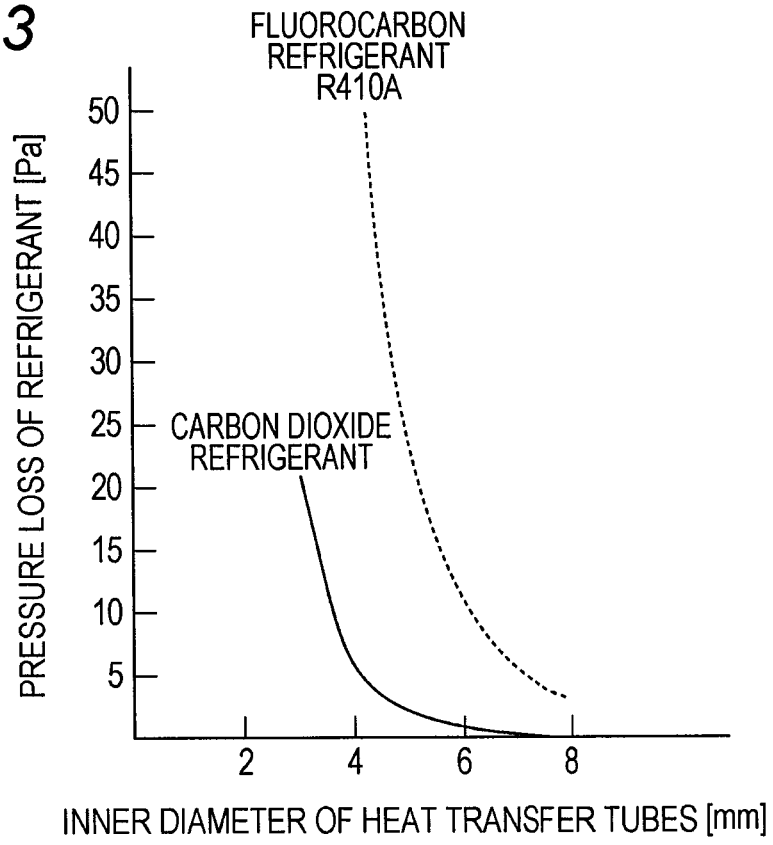
FIG. 13 illustrates a relationship between the inner diameter of the heat transfer tubes and the pressure loss of the refrigerant that runs through the heat transfer tubes.

In FIG. 3, a heat transfer tube 2 is formed to have an outer diameter D in a range of 5 mm≤D≤6 mm and a thickness t in a range of 0.05×D≤t≤0.09×D. FIG. 13 illustrates results of numerical analysis conducted by the inventors on the relationship between the inner diameter of the heat transfer tubes and the pressure loss of the refrigerants that run through the heat transfer tubes of refrigerant circuits using a carbon dioxide refrigerant and a fluorocarbon refrigerant (R410A) where the evaporation temperature of the refrigerants is 6.5° C. (the degree of superheating is 5° C.) and the outlet temperature of the evaporators is 11.5° C. As illustrated in FIG. 13, the pressure loss of the refrigerants that runs through the heat transfer tubes increases exponentially with a decrease in inner diameter of the heat transfer tubes from 4 mm in case of using a carbon dioxide refrigerant. The pressure loss of the refrigerant increases exponentially with a decrease in inner diameter of the heat transfer tubes from 7 mm in case of using a conventional fluorocarbon refrigerant (R410A). The pressure loss of the carbon dioxide refrigerant in the heat transfer tubes of 4 mm in inner diameter is approximately equal in value to the pressure loss of the fluorocarbon refrigerant in the heat transfer tubes of 7 mm in inner diameter. Accordingly, in case of using a carbon dioxide refrigerant, heat transfer tubes of 4 mm or more in inner diameter are preferably used. In refrigerant circuits using a carbon dioxide refrigerant, the refrigerant pressure within the circuits amounts to, for example, 9 MPa to 10 MPa. This is a high pressure value which is about three to four times that of the fluorocarbon refrigerant. Thus, the heat transfer tubes 2 need to have a thickness that allows for durability against such high pressure, while a thickness that is larger than necessary hinders achievement of reduction in weight of the heat exchanger. Accordingly, in order to achieve sufficient durability against the high pressure of the carbon dioxide refrigerant and reduction in weight of the heat exchanger 1, the heat transfer tubes 2 shall have a thickness that is not less than 5% and not more than 9% of the outer diameter D thereof. By setting the outer diameter D of the heat transfer tubes 2 in a range of 5 mm≤D≤6 mm and the thickness of the heat transfer tubes 2 in the above range, the heat transfer tubes 2 can have an inner diameter of not less than 4 mm, which allows for avoidance of excessive increase in pressure loss of the refrigerant, as well as reduction in weight of the heat exchanger.

Figure 4:
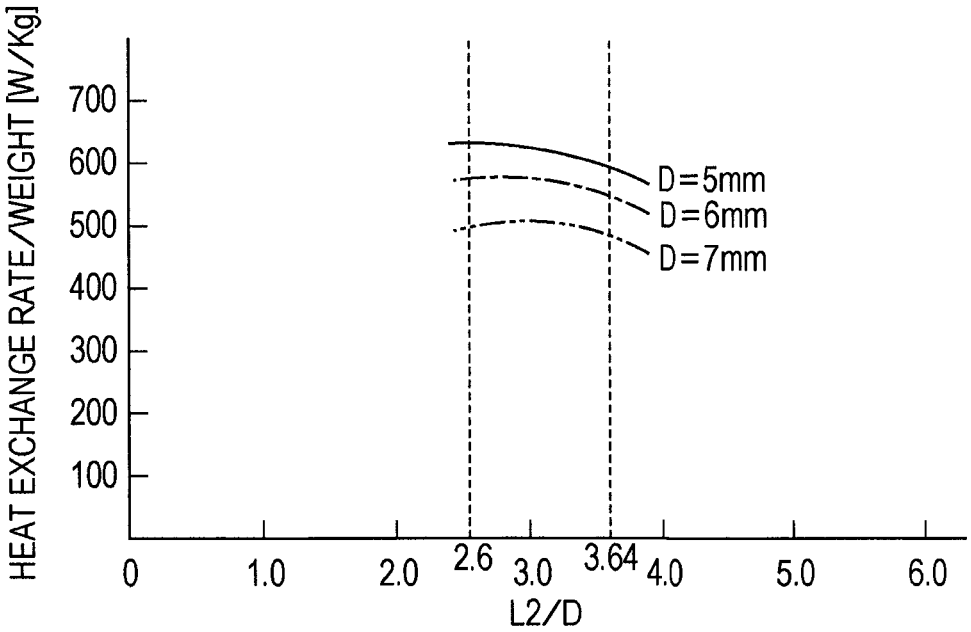
FIG. 4 illustrates the heat exchange rate per unit weight of the heat exchanger and the relationship (L2/D) of the longitudinal pitch L2 of the heat transfer tubes/the outer diameter D of the heat transfer tubes.
Figure 5:
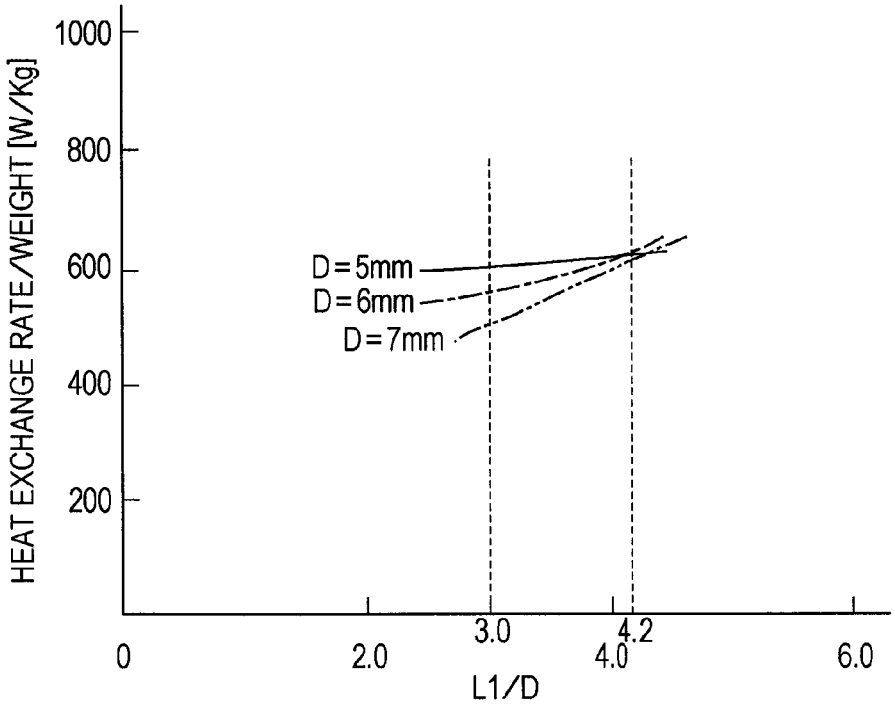
FIG. 5 illustrates the heat exchange rate per unit weight of the heat exchanger and the relationship (L1/D) of the vertical pitch L1 of the heat transfer tubes/the outer diameter D of the heat transfer tubes.

The heat transfer tubes 2 are disposed such that the vertical pitch L1 of the heat transfer tubes 2 is in a range of 3×D≤L1≤4.2×D with the longitudinal pitch L2 of the heat transfer tubes 2 in a range of 2.6×D≤L2≤3.64×D. As illustrated in FIGS. 4 and 5, where the vertical pitch L1 of the heat transfer tubes 2 is in the range of 3×D≤L1≤4.2×D with the longitudinal pitch L2 of the heat transfer tubes 2 in the range of 2.6×D≤L2≤3.64×D, a heat exchanger with heat transfer tubes 2 of 5 mm or 6 mm in outer diameter D has a larger heat exchange rate per unit weight than a heat exchanger 1 with heat transfer tubes 2 of 7 mm in outer diameter D. Particularly, the heat exchange rate per unit weight has a maximum value at a point where the outer diameter D is 5 mm. Accordingly, the outer diameter D of the heat transfer tubes 2 most preferably has a value in a range of 5 mm≤D≤5.5 mm. The number of longitudinal rows N of the heat transfer tubes is preferably in a range of 2≤N≤8. The heat exchange capability per unit weight of the heat exchanger falls when the number of rows N of the heat transfer tubes is one or not less than nine.

Figure 6:
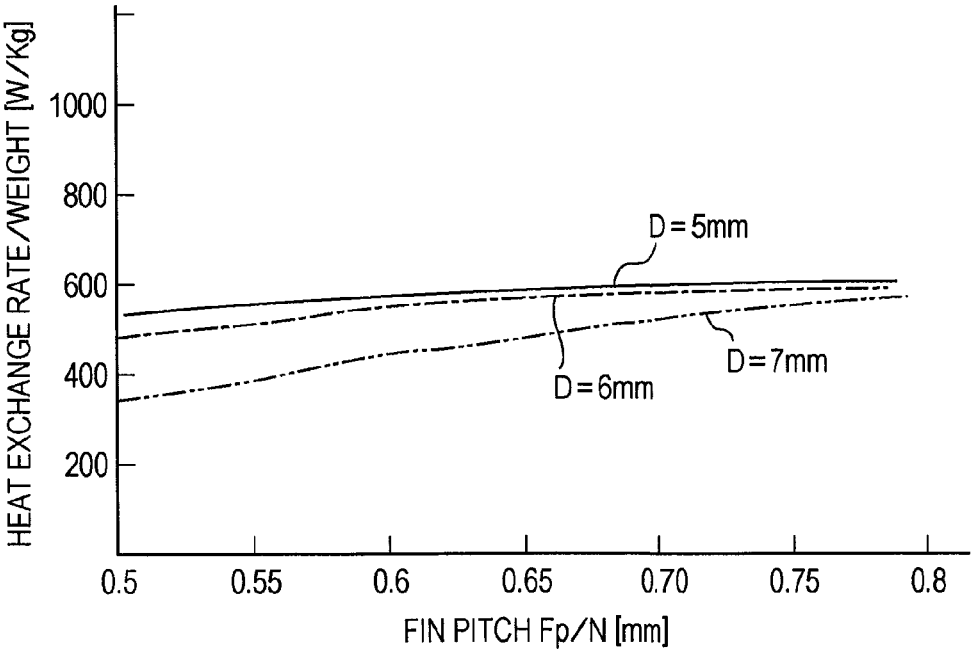
FIG. 6 illustrates a relationship between the heat exchange rate per unit weight of the heat exchanger and the fin pitch Fp of heat transfer fins.

The heat transfer fins 3 are preferably disposed such that the fin pitch Fp/N is in a range of 0.5 mm≤Fp/N≤0.9 mm. As illustrated in FIG. 6, at a point where the fin pitch Fp/N is in the range, a heat exchanger with heat transfer tubes 2 of 5 mm or 6 mm in outer diameter D has a larger heat exchange rate per unit weight than a heat exchanger with heat transfer tubes 2 of 7 mm in outer diameter D.

Figure 7:
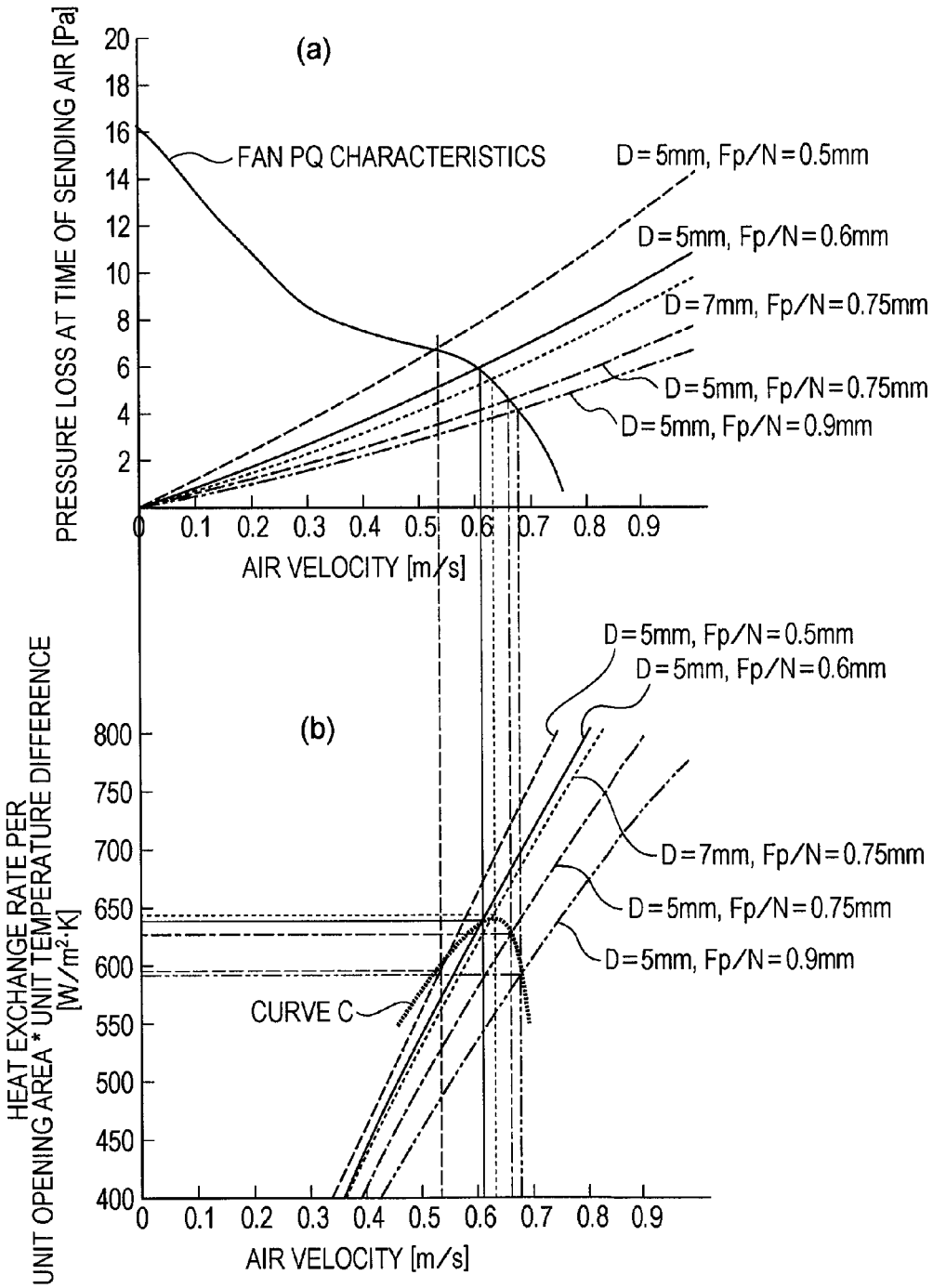
FIG. 7(*a*) illustrates a relationship between the velocity of air that passes between the heat transfer fins at the time of sending air and the pressure loss, and FIG. 7(*b*) illustrates a relationship between the velocity of air that passes through the heat transfer fins at the time of sending air and the heat exchange rate per unit opening area and unit temperature difference.

In FIGS. 7(*a*) and 7(*b*), the air velocity indicated by the abscissa axis shows the velocity of air that passes between the heat transfer fins 3, which air is sent to the fins 3 by a fan. The pressure loss at the time of sending air indicated by the vertical axis shows the pressure loss in case where the air passes between the fins by an air velocity on the abscissa axis. The heat exchange rate per unit opening area and unit temperature difference indicated by the vertical axis shows the heat exchange rate in case were the air passes between the fins at an air velocity on the abscissa axis. FIG. 7(*a*) illustrates a relational curve of the pressure loss at the time of sending air and the air velocity with respect to heat exchangers 1 having heat transfer tubes 2 with an outer diameter D of 5 mm and a thickness t of 0.3 mm with the fin pitch Fp/N thereof being any of 0.5 mm, 0.6 mm, 0.75 mm, and 0.9 mm, and to a heat exchanger (a comparative example) having heat transfer tubes 2 with an outer diameter D of 7 mm and a thickness t of 0.45 mm with the fin pitch Fp/N being 0.75 mm. The air velocity and pressure loss defined by intersections of the relational curves and the fan PQ characteristic curve indicate the velocity and pressure loss of the air that passes between the fins of the heat exchangers 1. FIG. 7(*b*) illustrates the heat exchange rate per unit opening area and unit temperature difference of the heat exchangers 1 at the air velocities defined in FIG. 7(*a*). In FIG. 7(*b*), the curve C shows change in heat exchange rate of a heat exchanger having heat transfer tubes 2 of 5 mm in outer diameter and 0.3 mm in thickness t with the fin pitch Fp/N thereof varied as 0.5 mm, 0.6 mm, 0.75 mm, and 0.9 mm. As indicated by the curve C, the heat exchanger having the heat transfer tubes 2 of 5 mm in outer diameter D exhibits a maximum heat exchange rate per unit opening area and unit temperature difference at the fin pitch Fp/N of 0.6 mm while exhibiting an abrupt drop at a fin pitch Fp/N of less than 0.5 mm or more than 0.9 mm. Accordingly, the fin pitch Fp/N is preferably set in a range of 0.5 mm≤Fp/N≤0.9 mm. Further, as illustrated in FIG. 7(*b*), the heat exchanger 1 having the heat transfer tubes 2 of 5 mm in outer diameter D with the fin pitch Fp/N being 0.75 mm exhibits an approximately equal level of performance in terms of heat exchange rate per unit opening area and unit temperature difference to that of the heat exchanger (the comparative example) having the heat transfer tubes of 7 mm in outer diameter D with the fin pitch Fp/N being 0.75 mm. This indicates that a reduced diameter of the heat transfer tubes 2, thus a reduced weight of the heat exchangers, is achieved with the heat exchange performance per unit opening area and unit temperature difference maintained at a substantially equal level.

Example 2

The following results were obtained by a comparison test on the heat exchange performance of the respective heat exchangers of an example and a comparative example described below. In either test of the example and the comparative example, the outer diameter D of the heat transfer tubes 2 was 5 mm, the thickness t of the heat transfer tubes 2 was 0.3 mm, and the number of longitudinal rows N of the heat transfer tubes 2 was two. The fin pitch Fp/N of the heat transfer fins 3 was 0.75 mm. Further, carbon dioxide was used as the refrigerant. The example was different from the comparative example in the vertical pitch L1 and longitudinal pitch L2 of the heat transfer tubes 2.

Heat Exchanger of Example:

Five heat exchangers 1 of the example had heat transfer tubes 2 with mutually different L1 and L2. The L1 values of the heat exchangers 1 are denoted by the five dots in the range of 15 mm≤L1≤21 mm illustrated in FIG. 8. The L2 values of the heat exchangers 1 are denoted by the five dots in the range of 13 mm≤L2≤18.2 mm illustrated in FIG. 9. The heat transfer tubes 2 were disposed such that the corresponding L1 and L2 values make one set.

Heat Exchanger of Comparative Example:

Three heat exchangers 1 of the comparative example had heat transfer tubes 2 with mutually different L1 and L2. The L1 values of the heat exchangers 1 are denoted by the three dots in the ranges of L1<15 mm and L1>21 mm illustrated in FIG. 8. The L2 values of the heat exchangers 1 are denoted by the three dots in the ranges of L2<13 mm and L2>18.2 mm illustrated in FIG. 9. The heat transfer tubes 2 were disposed such that the corresponding L1 and L2 values make one set.

Figure 8:
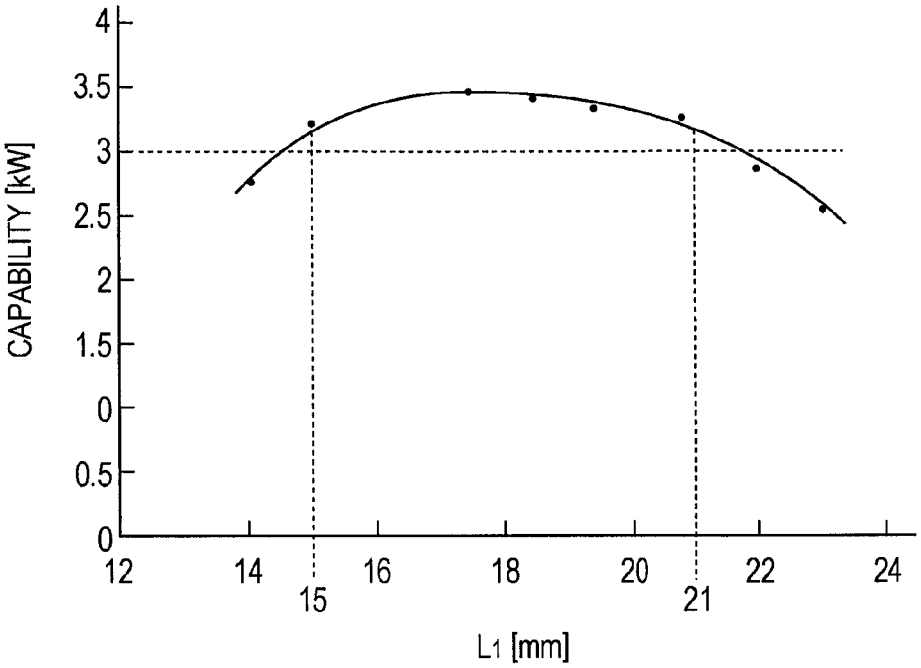
FIG. 8 illustrates a relationship between the vertical pitch L1 of the heat transfer tubes and the heat exchange capability.
Figure 9:
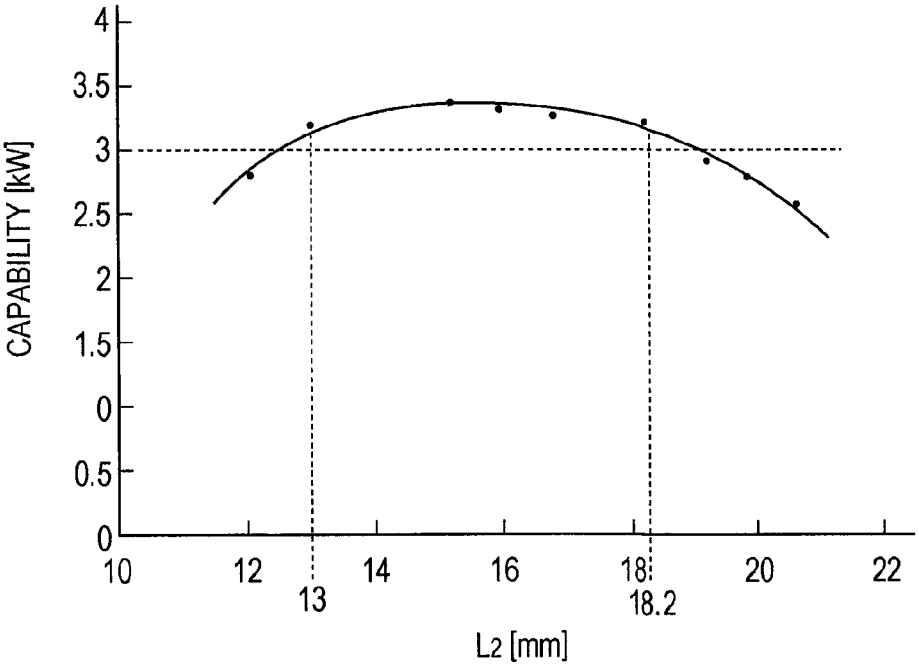
FIG. 9 illustrates a relationship between the longitudinal pitch L2 of the heat transfer tubes and the heat exchange capability.

As illustrated in FIGS. 8 and 9, as high a heat exchange capability as not less than 3.2 KW was provided by the heat exchangers 1 of the example with L1 being in the range of 15 mm≤L1≤21 mm and L2 being in the range of 13 mm≤L2≤18.2 mm. Meanwhile, as illustrated in the figures, where L1 is in the ranges of L1<15 mm and L1>21 mm and L2 is in the ranges of L2<13 mm and L2>18.2 mm, a fall was seen in the heat exchange capability of the heat exchangers 1 of the comparative example from that of the example. Since the outer diameters D of the heat transfer tubes 2 are 5 mm in the example and the comparative example, 15 mm≤L1≤21 mm of the example equals to 3×D≤L1≤4.2×D, and 13 mm≤L2≤18.2 mm, to 2.6×D≤L2≤3.64×D. Meanwhile, the ranges L1<15 mm and L1>21 mm of the comparative example are outside of the range of 3×D≤L1≤4.2×D, and the ranges of L2<13 mm and L2>18.2 mm are outside of the range of 2.6×D≤L2≤3.64×D.

Example 3

The following results were obtained by a comparison test on the heat exchange performance of the respective heat exchangers 1 of an example and a comparative example described below. In either test of the example and the comparative example, the vertical pitch L1 of the heat transfer tubes 2 was 21 mm, and the longitudinal pitch L2 thereof was 18.2 mm. Carbon dioxide was used as the refrigerant. The example is different from the comparative example in the outer diameter D and thickness t of the heat transfer tubes 2, and the fin pitch Fp.

Heat Exchanger of Example:

The heat exchanger 1 of the example had heat transfer tubes 2 of 5 mm in outer diameter D and 0.3 mm in thickness t. The number of longitudinal rows N of the heat transfer tubes 2 was two, and the fin pitch Fp/N of the heat transfer fins 3 was 0.6 mm or 0.75 mm.

Heat Exchanger of Comparative Example:

The heat exchanger 1 of the comparative example had heat transfer tubes 2 of 7 mm in outer diameter D and 0.45 mm in thickness t. The number of longitudinal rows N of the heat transfer tubes 2 was two, and the fin pitch Fp/N of the heat transfer fins 3 was 0.75 mm.

Figure 10:
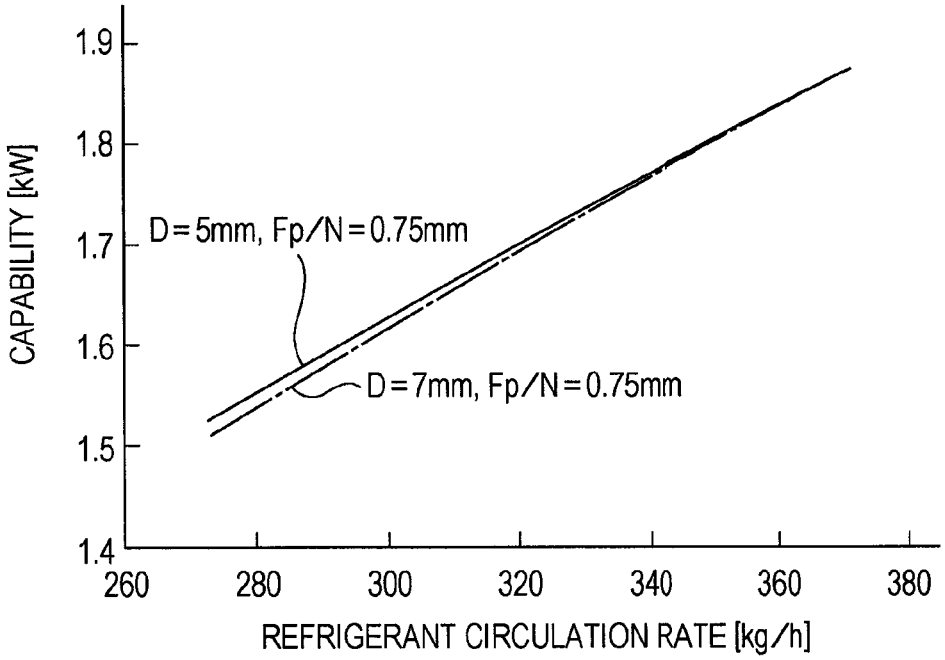
FIG. 10 illustrates a relationship between the circulation rate of a refrigerant of the heat exchanger and the heat exchange capability.
Figure 11:
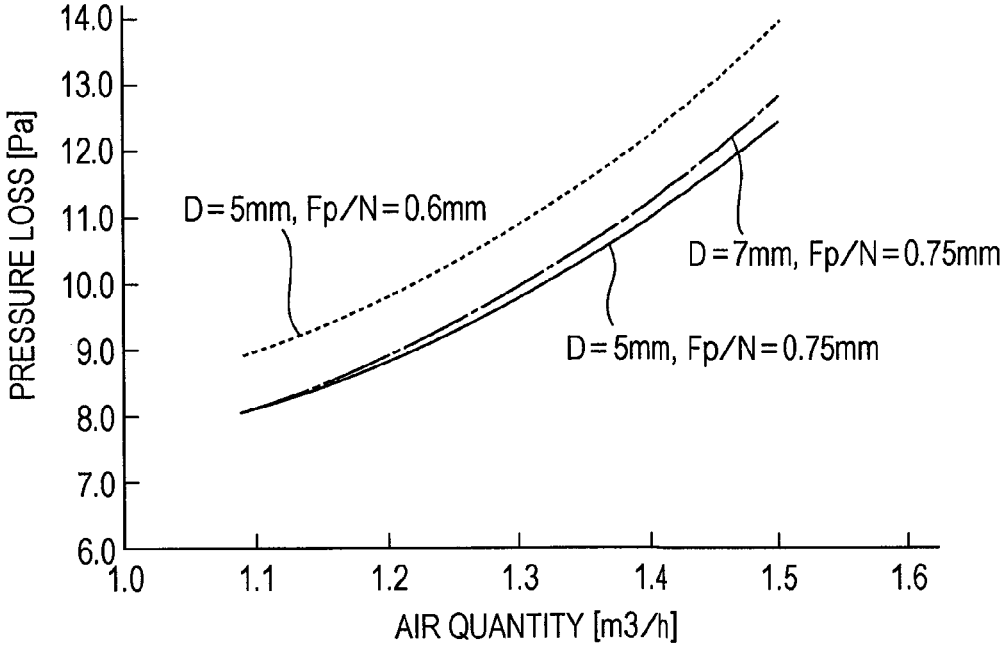
FIG. 11 illustrates a relationship between the quantity of air that passes between the heat transfer fins at the time of sending air and the pressure loss.
Figure 12:
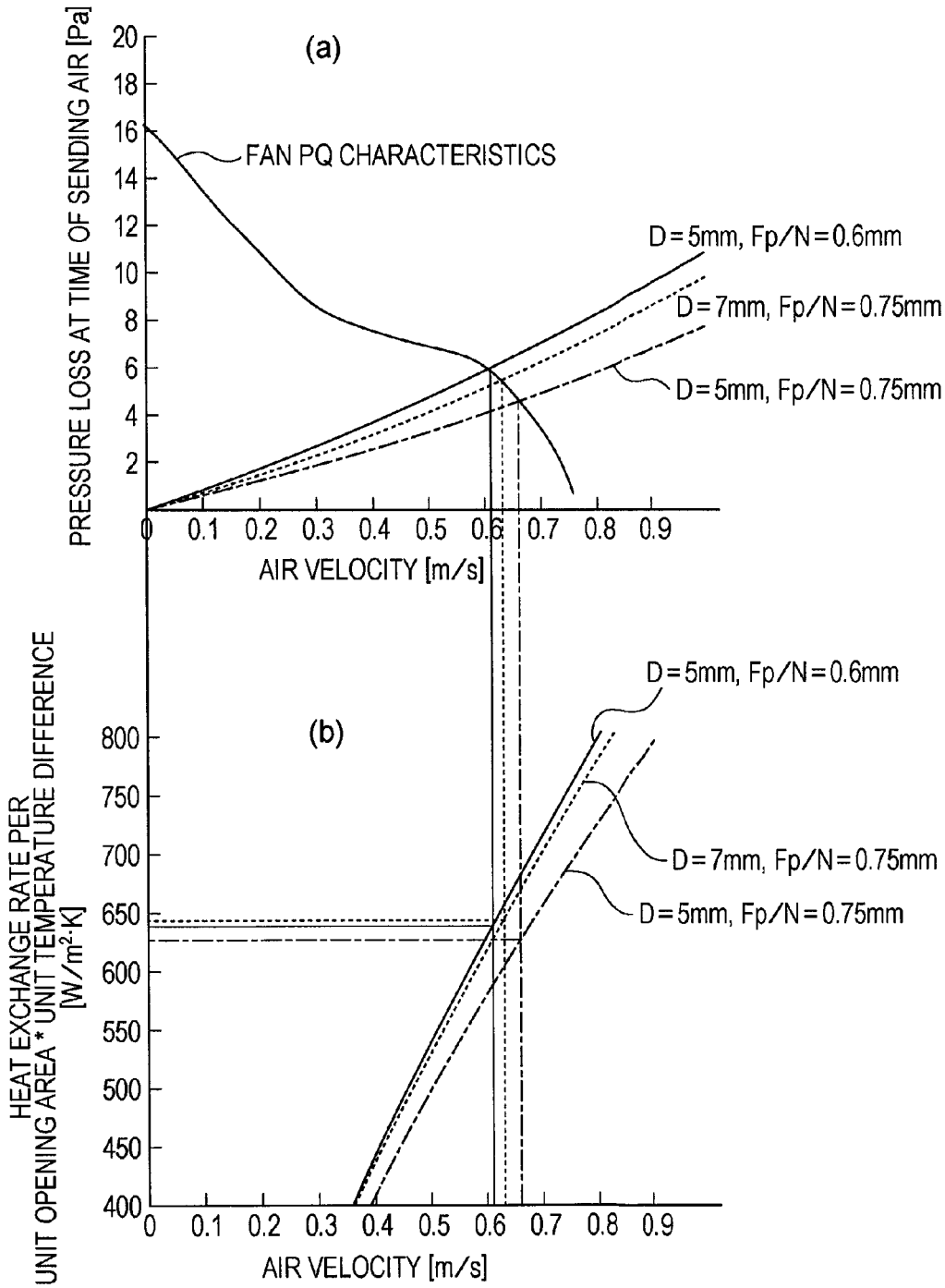
FIG. 12(*a*) illustrates a relationship between the velocity of air that passes between the heat transfer fins at the time of sending air and the pressure loss, and FIG. 12(*b*) illustrates a relationship between the velocity of air that passes between the heat transfer fins at the time of sending air and the heat exchange rate per unit opening area and unit temperature difference.

As illustrated in FIG. 10, the heat exchanger 1 of the example with a fin pitch Fp/N of 0.75 mm has, although its heat transfer tubes 2 has a smaller outer diameter D than those of the comparative example by 2 mm, heat exchange capability that is approximately equal to that of the comparative example at the same refrigerant circulation rate. Meanwhile, as illustrated in FIG. 11, the heat exchanger 1 of the example with the fin pitch Fp/N of 0.75 mm is approximately equal in pressure loss at the time of sending air to the comparative example, and the heat exchanger 1 of the example with the fin pitch Fp/N of 0.6 mm shows larger pressure loss at the time of sending air than that of the comparative example. However, as illustrated in FIGS. 12(*a*) and 12(*b*), the heat exchanger 1 of the example with the fin pitch Fp/N of 0.6 mm exhibits performance that is approximately equal to that of the comparative example in terms of heat exchange rate per unit opening area and unit temperature difference of the heat exchanger, despite the large pressure loss at the time of sending air. This indicates that a reduced diameter of the heat transfer tubes 2, thus a reduced weight of the heat exchanger, is achieved with the heat exchange performance per unit opening area and unit temperature difference maintained at a substantially equal level.

Example 4

Figure 14:
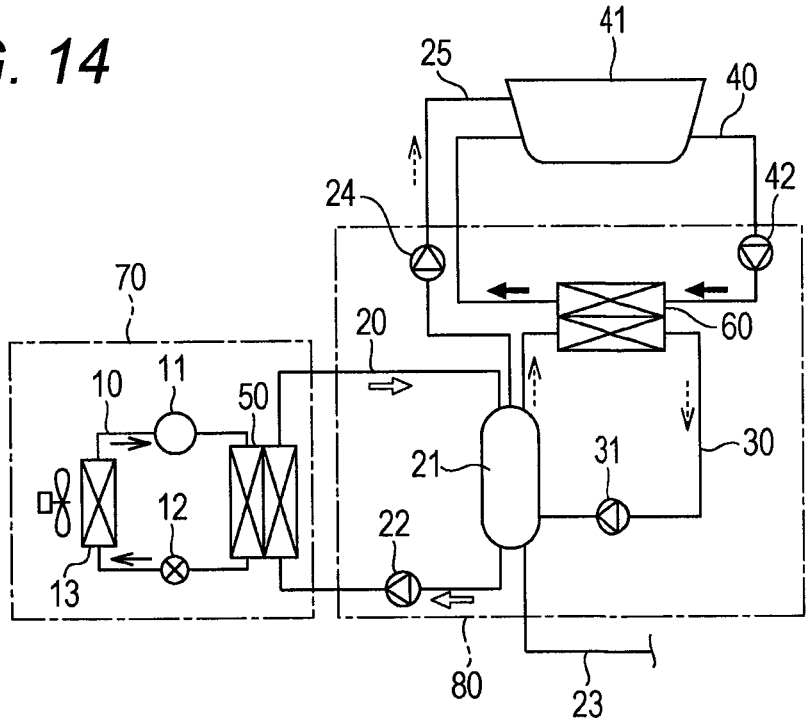
FIG. 14 illustrates a schematic configuration view of a heat pump water heater using a heat exchanger of the invention.

A heat pump water heater illustrated in FIG. 14 uses a heat exchanger of the invention as an evaporator of a refrigerant circuit. As illustrated in FIG. 14, the heat pump water heater includes: a refrigerant circuit 10 through which a refrigerant is circulated; a first water heating circuit 20 through which water to be supplied is circulated; a second water heating circuit 30 through which water to be supplied is circulated; a bathtub circuit 40 through which water for use in a bathtub is circulated; a first water heat exchanger 50; and a second water heat exchanger 60. The first water heat exchanger 50 performs heat exchange between the refrigerant of the refrigerant circuit 10 and the water to be supplied of the first water heating circuit 20. The second water heat exchanger 60 performs heat exchange between the water to be supplied of the second water heating circuit 30 and the water for use in the bathtub of the bathtub circuit 40.

The refrigerant circuit 10 comprises a coupling of a compressor 11, an expansion valve 12, an evaporator 13, and the first water heat exchanger 50, such that the refrigerant is circulated through the compressor 11, the first water heat exchanger 50, the expansion valve 12, the evaporator 13, and the compressor 11 in this order. The evaporator 13 includes a heat exchanger of the invention. The refrigerant used in this refrigerant circuit 10 is carbon dioxide.

The first water heating circuit 20 comprises a coupling of a water storage tank 21, a first pump 22, and the first water heat exchanger 50, such that the water to be supplied is circulated through the water storage tank 21, the first pump 22, the first water heat exchanger 50, and the water storage tank 21 in this order. The water storage tank 21 is coupled with a water supply pipe 23 and the second water heating circuit 30, such that the water to be supplied that is fed from the water supply pipe 23 circulates through the first water heating circuit 20 via the water storage tank 21. The water storage tank 21 and a bathtub 41 are coupled to each other by means of a channel 25 provided with a second pump 24, such that the water to be supplied that is stored in the water storage tank 21 is fed to the bathtub 41 by the second pump 24.

The second water heating circuit 30 comprises a coupling of the water storage tank 21, a third pump 31, and the second water heat exchanger 60, such that the water to be supplied is circulated through the water storage tank 21, the second water heat exchanger 60, the third pump 31, and the water storage tank 21 in this order.

The bathtub circuit 40 comprises a coupling of the bathtub 41, a fourth pump 42, and the second water heat exchanger 60, such that the water for use in the bathtub is circulated through the bathtub 41, the fourth pump 42, the second water heat exchanger 60, and the bathtub 41 in this order.

The first water heat exchanger 50 is coupled to the refrigerant circuit 10 and the first water heating circuit 20, such that heat exchange is performed between the refrigerant serving as a first heat medium that circulates through the refrigerant circuit 10 and the water to be supplied serving as a second heat medium that circulates through the first water heating circuit 20.

The second water heat exchanger 60 is coupled to the second water heating circuit 30 and the bathtub circuit 40, such that heat exchange is performed between the water to be supplied of the second water heating circuit 30 and the water for use in the bathtub of the bathtub circuit 40.

The water heater also includes: a heating unit 70 having therein the refrigerant circuit 10 and the first water heat exchanger 50; and a tank unit 80 having therein the water storage tank 21, the first pump 22, the second pump 24, the second water heating circuit 30, the fourth pump 42, and the second water heat exchanger 60. The heating unit 70 is coupled to the tank unit 80 by means of the first water heating circuit 20.

In the water heater thus configured, heat exchange is performed between the high temperature refrigerant of the refrigerant circuit 10 and the water to be supplied of the first water heating circuit 20 by the first water heat exchanger 50, while the water to be supplied that is heated by the first water heat exchanger 50 is stored in the water storage tank 21. Heat exchange is performed between the water to be supplied in the water storage tank 21 and the water for use in the bathtub of the bathtub circuit 40 by the second water heat exchanger 60, so that the water for use in the bathtub that has been heated by the second water heat exchanger 60 is supplied to the bathtub 41.

While the foregoing embodiment provides an example in which the heat exchanger of the invention is used as the evaporator 13 of a heat pump water heater, the heat exchanger of the invention is applicable as another heat exchanger, e.g. an evaporator of a vending machine.

INDUSTRIAL APPLICABILITY

Since the present invention allows for improved heat exchange capability of heat exchangers as well as reduced dimensions and weight of the heat exchangers, the invention may be used widely as a heat exchanger in air conditioning, freezing, refrigerating, water heating, and the like. Particularly, application is available as an evaporator of a heat pump water heater or of a refrigerant circuit of a vending machine that use a carbon dioxide refrigerant.

The invention claimed is:

1. A heat exchanger comprising:

a plurality of heat transfer tubes spaced from one another in a radial direction thereof and arranged vertically and longitudinally;

a plurality of heat transfer fins spaced from one another and disposed in an axial direction of the heat transfer tubes; and a carbon dioxide refrigerant provided for circulation through the heat transfer tubes, wherein each of the heat transfer tubes has an inner diameter of 4 mm or more, an outer diameter D in a range of 5 mm D 6 mm, and a thickness t in a range of $0.05 \times D \leq t \leq 0.09 \times D$, the heat transfer tubes are disposed at a vertical pitch L1 in a range of $3 \times D \leq L1 \leq 4.2 \times D$, the heat transfer tubes are disposed at a longitudinal pitch L2 in a range of $2.6 \times D \leq L2 \leq 3.64 \times D$, a number of longitudinal rows N of the heat transfer tubes is in a range of $2 \leq N \leq 8$, the heat transfer fins are disposed at a pitch Fp in the axial direction of the heat transfer tubes, and a value of Fp/N is in a range of 0.5 mm$\leq$Fp/N$\leq$0.9 mm, the Fp/N value being given by dividing Fp by the number of longitudinal rows N of the heat transfer tubes.

2. The heat exchanger according to claim 1, wherein the outer diameter D of the heat transfer tubes is in a range of 5 mm$\leq$D$\leq$5.5 mm.

3. The heat exchanger according to claim 2, wherein the heat transfer tubes are disposed such that an equilateral triangle is formed by center-to-center lines of the heat transfer tubes adjoining each other vertically and longitudinally.

4. A heat pump device comprising the heat exchanger of claim 3 as an evaporator of a refrigerant circuit thereof.

5. A heat pump device comprising the heat exchanger of claim 2 as an evaporator of a refrigerant circuit thereof.

6. The heat exchanger according to claim 1, wherein the heat transfer tubes are disposed such that an equilateral triangle is formed by center-to-center lines of the heat transfer tubes adjoining each other vertically and longitudinally.

7. A heat pump device comprising the heat exchanger of claim 6 as an evaporator of a refrigerant circuit thereof.

8. A heat pump device comprising the heat exchanger of claim 1 as an evaporator of a refrigerant circuit thereof.

* * * * *